US011614295B2

(12) United States Patent
Gourdet et al.

(10) Patent No.: US 11,614,295 B2
(45) Date of Patent: Mar. 28, 2023

(54) VALVE SLEEVE FOR CT40 CANNON

(71) Applicant: CTA INTERNATIONAL, Bourges (FR)

(72) Inventors: Anne Gourdet, Bourges (FR); Frédéric Rouhaut, Bourges (FR); Colin Stephenson, Bourges (FR); Patrice Pichot, Bourges (FR)

(73) Assignee: CTA INTERNATIONAL, Bourges (FR)

( * ) Notice: Subject to any disclaimer, the term of this patent is extended or adjusted under 35 U.S.C. 154(b) by 0 days.

(21) Appl. No.: 17/599,928

(22) PCT Filed: Apr. 30, 2020

(86) PCT No.: PCT/EP2020/000089
§ 371 (c)(1),
(2) Date: Sep. 29, 2021

(87) PCT Pub. No.: WO2020/200511
PCT Pub. Date: Oct. 8, 2020

(65) Prior Publication Data

US 2022/0011069 A1 Jan. 13, 2022

(30) Foreign Application Priority Data

Mar. 29, 2019 (FR) ..... 1903405

(51) Int. Cl.
*F41A 19/36* (2006.01)

(52) U.S. Cl.
CPC ..... *F41A 19/36* (2013.01)

(58) Field of Classification Search
CPC ..... F41A 19/13; F41A 19/27; F41A 19/43; F41A 19/49
See application file for complete search history.

(56) References Cited

U.S. PATENT DOCUMENTS 381,264 A * 4/1888 Lorenz ..... F41A 19/13 89/27.11
824,130 A * 6/1906 Meigs ..... F41A 19/13 89/27.11

(Continued)

FOREIGN PATENT DOCUMENTS

EP 0 519 785 A1 12/1992
EP 0 660 068 A1 6/1995

OTHER PUBLICATIONS

Sep. 24, 2021 International Search Report issued in International Patent Application No. PCT/EP2020/000089.

(Continued)

*Primary Examiner* — Bret Hayes
(74) *Attorney, Agent, or Firm* — Oliff PLC

(57) ABSTRACT

A valve sleeve for a CT40-type cannon that functions in association with a detonation assembly to activate a firing pin. The valve sleeve incorporates a receiver to ensure the mechanical support of the cannon's firing pin during firing events, the firing pin being coupled to the valve sleeve and translatable in relation to it, the receiver being constituted by a cylindrical firing pin sleeve, a firing pin valve, and a firing pin assembly inserted in the substantially cylindrical sleeve and the firing pin being inserted both in the valve and in the firing pin assembly, this receiver being revolving.

7 Claims, 4 Drawing Sheets

(56) References Cited

U.S. PATENT DOCUMENTS

Figure 1:
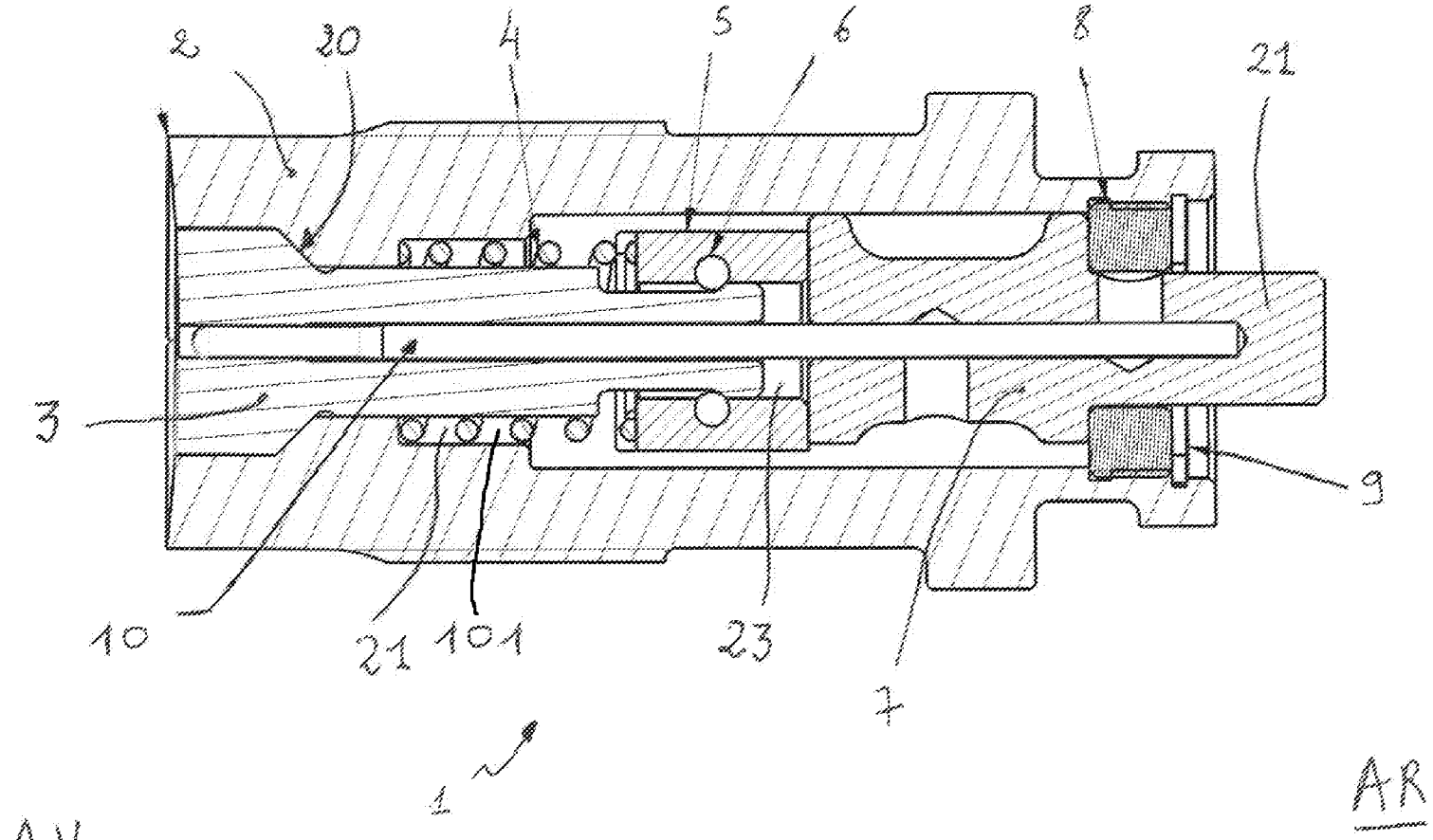

| | | | | |
|---|---|---|---|---|
| 2,382,225 | A | 8/1945 | Hochstetler | |
| 4,581,836 | A * | 4/1986 | Baker | F41A 19/13 42/69.01 |
| 5,235,770 | A | 8/1993 | Simon et al. | |
| 5,604,326 | A | 2/1997 | Lescure | |
| 7,357,059 | B2 * | 4/2008 | Könicke | F41A 29/04 89/26 |
| 2007/0199434 | A1 | 8/2007 | Crotty et al. | |

OTHER PUBLICATIONS

Sep. 24, 2021 Written Opinion issued in International Patent Application No. PCT/EP2020/000089.

* cited by examiner

VALVE SLEEVE FOR CT40 CANNON

The technical scope of the present invention is that of firing pins for weapons of large and medium caliber, namely cannons for tank turrets, and in particular for the cannon CT40.

The CT40 cannon uses a specific type of ammunition: telescoped ammunition. This ammunition, whose structure is known, is particular in that the projectile is inside the cartridge and does not protrude from the cartridge's rear end. There are different types, and the CT40 cannon may use different natures of ammunition, for example anti-tank, explosive or practice ammunition.

This ammunition is advanced technology ammunition, whose use requires a high-tech precision weapon whose operation is performed by trained and qualified personnel.

Thus, the CT40 cannon has a specific part, among its constitutive parts, which is the valve sleeve that ensures the mechanical support of the firing pin when the telescoped ammunition is being fired.

In this known version of the valve sleeve, the latter functions in coordination with the detonation assembly. The firing pin is integral with the telescopic detonation assembly and the valve sleeve has a central longitudinal recess in which the firing pin slides. The valve sleeve thus ensures the correct positioning of the firing pin and, by the sliding of its rear part, the mechanical support required for successful detonation.

This valve sleeve gives the CT40 proven effectiveness and reliability, but also imposes a constraint. Indeed, if the gunner forgets to install the valve sleeve in the barrel, the cannon may be subject to a misfire.

So as to overcome such a risk, the present invention provides a new valve sleeve preventing such misfires.

The invention thus relates to a valve sleeve for a CT40-type cannon that functions in association with a detonation assembly, wherein said valve sleeve incorporates receiving means to ensure the mechanical support of the cannon's firing pin during firing events.

According to a feature of the valve sleeve, the firing pin of the cannon is coupled to said valve sleeve and is translatable in relation to it.

According to another characteristic of the valve sleeve, the receiving means are constituted by a substantially cylindrical firing pin sleeve, a firing pin valve and a firing pin assembly inserted in said cylindrical sleeve and the firing pin inserted both in the valve and in the firing pin assembly, these means being revolving.

According to yet another characteristic of the valve sleeve, a ring is placed between the valve and the firing pin assembly, said ring being connected to the valve by a cylindrical pin and able to slide with respect to the valve.

According to yet another characteristic of the valve sleeve, the sleeve comprises a spring inserted in a cage delimited by this sleeve and arranged to press against the ring, said spring being intended to bring the valve back into its initial resting position.

According to yet another characteristic of the valve sleeve according to the invention, the spring is compressed by the ring during the translational movement of the firing pin assembly.

According to yet another characteristic of the valve sleeve, the firing pin assembly is held in position by a cap and an elastic ring.

According to yet another characteristic of the valve sleeve according to the invention, the sleeve is made of a material such as steel with high mechanical strength that is resistant to both heat and pressure.

An advantage of the valve sleeve according to the invention lies in the fact that it is impossible to engage firing if said sleeve is not inserted into the cannon. It therefore ensures foolproof mechanical support of the firing pin during firing.

The result of this is that faulty ignition is impossible, thereby preventing misfires.

Figure 2:
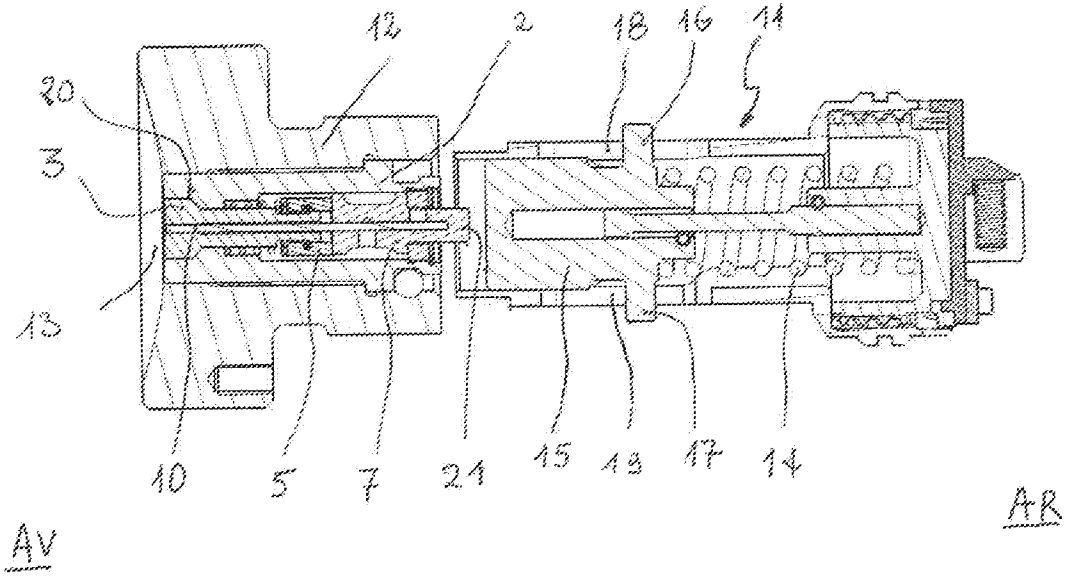
Figure 3:
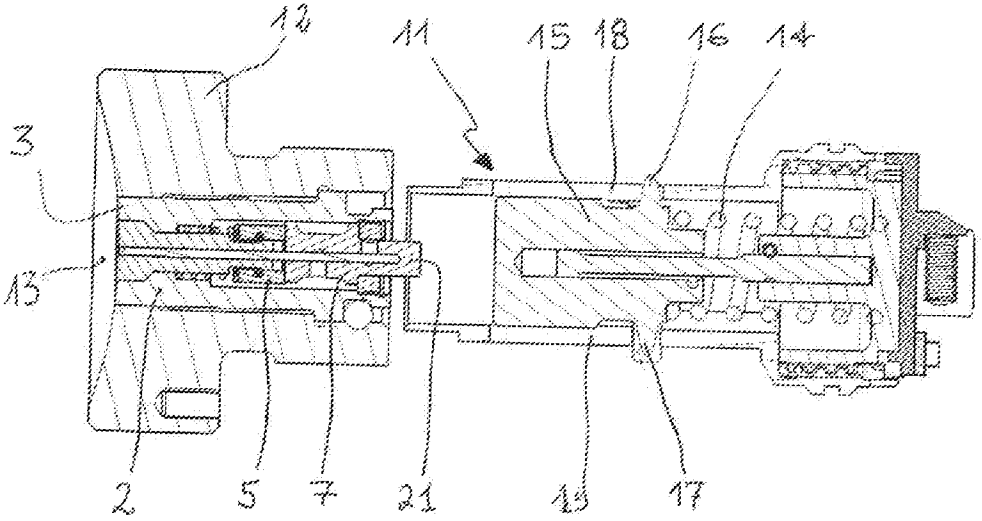
Figure 4:
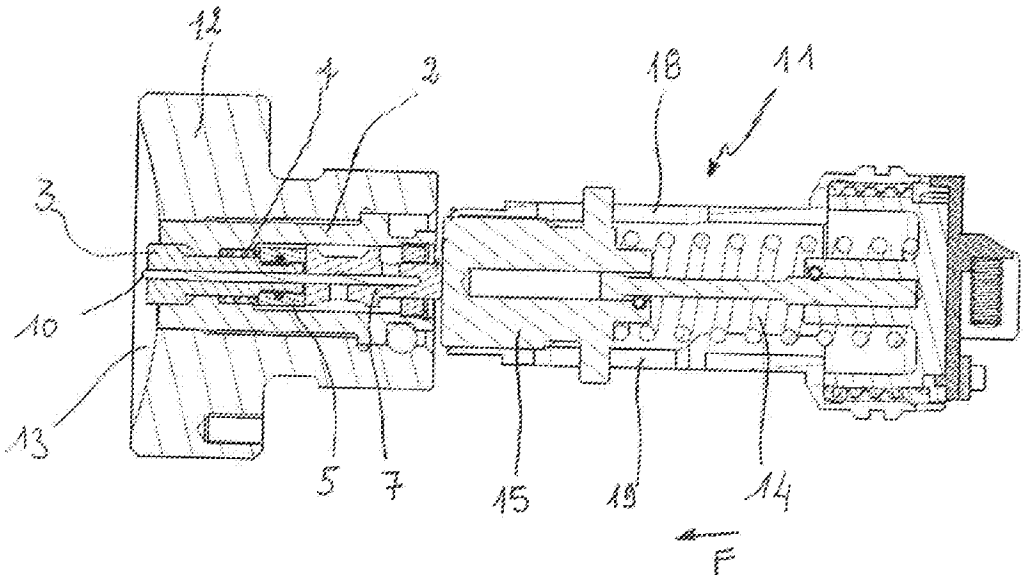

Other characteristics, advantages and particulars of the invention will be better understood from the additional description given hereafter by way of illustration and with reference to the drawings, in which:

FIG. 1 is a longitudinal section view of the valve sleeve according to the invention, FIG. 2 is a cross-sectional view of the valve sleeve integrated into the percussion plate, associated with the detonation assembly, in the resting position, FIG. 3 is a cross-sectional view of the valve sleeve, associated with the detonation assembly, in the armed position, and FIG. 4 is a cross-sectional view of the valve sleeve associated with the detonation assembly, in the detonation position.

FIG. 1 shows a longitudinal view of the valve sleeve 1 in the form of a machined single part 2 and enclosing from front to back a firing pin valve 3, a spring guide 5 and a firing pin assembly 7, these different elements being mobile inside the sleeve 1 as will be explained hereafter. This Figure represents the starting or inactive position of the firing pin assembly.

The firing pin valve 3 incorporates a first shoulder 20 cooperating with a matching shoulder on the valve 1 constantly held and pressed together by means of a spring 4 in the resting position in the Figure. This spring 4 partially surrounds the valve 3 and is housed in a cage 101 delimited by the sleeve 1.

The spring guide 5 is in the form of a ring that presses, on one side, on the free end of the spring 4 and, on the other side, on the firing pin assembly 7. The spring guide 5 is held in position by a cylindrical pin 6 with respect to the valve 3.

The firing pin assembly 7 is held in place inside the sleeve 1 by a cap 8 and an elastic ring 9. This assembly 7 has a free end 21 that protrudes from the sleeve 1.

The firing pin 10 is coupled with and integrated into the sleeve. This firing pin 10 is arranged in a housing made both in the valve 3 and in the firing pin assembly 7 and is held tightly in this housing against the firing pin assembly. The Figure shows that the firing pin 10 is slightly retracted with respect to the front end of the valve and that the valve 3 is separated from the firing pin assembly 7 by the free space 23.

It goes without saying that the valve sleeve 1 is housed in the cannon so as to ensure the percussion of the ammunition and is operated by means of a detonation assembly.

FIGS. 2, 3 and 4 illustrate in detail the functioning of the valve sleeve according to the invention.

FIG. 2 shows that the valve sleeve 1 is linked to the detonation assembly 11 formed by a classical telescopic firing pin known to prior art and which does not require further description here. These two elements are in their resting positions. It may be noted that this assembly 11 namely comprises a spring 14, a propelling body 15 with protrusions 16, 17 that cooperate with grooves 18, 19 enabling the propelling body 15 to be immobilized in its position.

The valve sleeve 1 is inserted in the cannon of the weapon 12 and opens at the free end of the firing pin 10 in the detonation chamber 13, shown in a simplified manner. The ammunition is not shown.

It can be seen that, in this position, the firing pin 10 is entirely inserted into the sleeve body 2 and does not protrude forwards towards the ammunition to be fired. The spring 4 is untensed and holding the valve 3 in close contact with the sleeve 2 at the shoulder 20. The free end 21 of the firing assembly 7 protrudes from the body 2 and is positioned facing the detonation assembly 11.

FIG. 3 shows the first step of a firing event, such step consisting in arming the firing device. The valve sleeve 1 according to the invention remains in its resting position in this Figure.

The detonation assembly 11 is brought into its armed position through a recoil movement. The spring 14 is then compressed by the recoiling propelling body 15. Protrusions 16, 17 of the propelling body 15, combined with grooves 18, 19, enable the propelling body 15 to be immobilized in its armed position.

FIG. 4 shows the percussion moment, with the foremost position of the valve 3 under the impulsion of the detonation assembly 11 in the direction of arrow F.

In this position, the detonation assembly 11 can be seen to be released from its rearward immobilized position shown in FIG. 3 to strike the firing pin assembly 7 which, in turn, pushes the valve 3 in translation. To this end, the spring 14 is released and projects the propelling body 15 to drive the firing pin assembly 7.

As can be seen in this Figure, the firing pin assembly 7 translates in the sleeve body 2 and compresses the valve spring 4 until coming into contact with said valve 3 which propels the firing pin valve 3 forwards, in a translational movement, eliminating space 23 shown in FIG. 1.

This translational movement of the firing pin assembly 7 and the firing pin valve 3 drives the firing pin 10 which protrudes from the sleeve body 2 into the detonation space 13 of the cannon 12. The firing pin 10 strikes the primer of the ammunition (not shown) causing it to detonate.

It can easily be observed that the firing pin 10 has constant mechanical support throughout its passage in the valve sleeve 1 according to the invention.

Thus, the beginning and end positions of the movement of the firing pin 10 are perfectly known and ensured. Because of this, the firing pin 10 is in no way able to deviate from its trajectory and miss the ammunition primer, which would cause a misfire or hazardous detonation.

Additionally, since the firing pin 10 forms an integral part of the valve sleeve body 1, the weapon many not be used without it. Therefore, the risk of the gunner forgetting to put the valve sleeve into position in the cannon before firing is made impossible.

Thus, the firing pin 10 is unable to deviate from the optimal straight trajectory and no misfire events can occur.

It goes without saying that after firing, the valve 3 and firing pin assembly 7 are returned to their starting position shown in FIG. 2 by means of the spring 4.

What is claimed is:

1. A valve sleeve assembly for a CT40 cannon that is configured to function in association with a detonation assembly to activate a firing pin, wherein the valve sleeve assembly incorporates a receiving means to ensure mechanical support of the cannon's firing pin during firing events, and wherein the receiving means are constituted by a substantially cylindrical firing pin sleeve, a firing pin valve and a firing pin assembly inserted in the cylindrical sleeve and the firing pin inserted both in the valve and in the firing pin assembly.

2. A valve sleeve assembly according to claim 1, wherein the firing pin of the cannon is disposed within the valve sleeve assembly and is translatable in relation to the valve sleeve assembly.

3. A valve sleeve assembly according to claim 1, wherein a spring guide in a form of a ring is placed between the firing pin valve and the firing pin assembly, the spring guide being connected to the firing pin valve by a cylindrical pin and able to slide with respect to the firing pin valve.

4. A valve sleeve assembly according to claim 3, wherein the valve sleeve assembly comprises a spring inserted in a cage delimited by the valve sleeve assembly and arranged to press against the spring guide, the spring being intended to bring the valve back into an initial resting position.

5. A valve sleeve assembly according to claim 4, wherein the spring is compressed by the spring guide during translational movement of the firing pin assembly.

6. A valve sleeve assembly according to claim 1, wherein the firing pin assembly is held in position by a cap and an elastic ring.

7. A valve sleeve assembly according to claim 1, wherein the valve sleeve assembly is made of steel.

* * * * *